US008801225B2

(12) United States Patent
Dalsgaard

(10) Patent No.: US 8,801,225 B2
(45) Date of Patent: Aug. 12, 2014

(54) MOVING HEAD LIGHT FIXTURE WITH BUCKET SHAPED HEAD

(75) Inventor: Carsten Dalsgaard, Silkeborg (DK)

(73) Assignee: Martin Professional A/S, Arhus N (DK)

( * ) Notice: Subject to any disclaimer, the term of this patent is extended or adjusted under 35 U.S.C. 154(b) by 198 days.

(21) Appl. No.: 13/176,137

(22) Filed: Jul. 5, 2011

(65) Prior Publication Data

US 2011/0261568 A1 Oct. 27, 2011

Related U.S. Application Data

(63) Continuation-in-part of application No. PCT/DK2011/050041, filed on Feb. 11, 2011.

(30) Foreign Application Priority Data

Feb. 16, 2010 (DK) ..... 2010 00128

(51) Int. Cl.
*F21V 21/26* (2006.01)

(52) U.S. Cl.
USPC ..... 362/249.1; 362/269; 362/294; 362/372

(58) Field of Classification Search
USPC ..... 362/232, 233, 237, 249.03, 249.05, 362/249.07, 249.1, 249.11, 249.12, 249.13, 362/269, 285, 287, 371, 372, 418, 427, 428
See application file for complete search history.

(56) References Cited

U.S. PATENT DOCUMENTS

| | | | | |
|---|---|---|---|---|
| 5,205,643 | A * | 4/1993 | Lin | 362/427 |
| 5,950,340 | A * | 9/1999 | Woo | 362/249.05 |
| 6,945,678 | B2 * | 9/2005 | Sugihara et al. | 362/237 |
| 7,614,766 | B2 * | 11/2009 | Wang et al. | 362/269 |
| 7,950,821 | B1 * | 5/2011 | Georgitsis et al. | 362/371 |
| 8,162,502 | B1 * | 4/2012 | Zadro | 362/427 |
| 2004/0165385 | A1 * | 8/2004 | Belliveau | 362/428 |
| 2009/0154165 | A1 | 6/2009 | Salm et al. | |

FOREIGN PATENT DOCUMENTS

| | | | |
|---|---|---|---|
| EP | 1898145 | A1 | 3/2008 |
| EP | 2103865 | A1 | 9/2009 |
| FR | 2838178 | A1 | 10/2003 |

* cited by examiner

*Primary Examiner* — Y My Quach Lee
(74) *Attorney, Agent, or Firm* — Day Pitney LLP

(57) ABSTRACT

The present invention discloses an illumination device comprising a base, a yoke connected to and rotatable relative to the base and a head connected to and rotatable relative to the yoke. The head comprises at least one light source generating light a light beam and wherein the light sources are arranged in a bucket shaped outer shell. The present invention relates also to a method of manufacturing such moving head light fixture. Further the present invention relates to a moving head light fixture where the head comprises a number of light sources generating a light beam; means for receiving user input from a user; and means for providing visual feedback to the user.

22 Claims, 12 Drawing Sheets

MOVING HEAD LIGHT FIXTURE WITH BUCKET SHAPED HEAD

RELATED APPLICATIONS

This application is a continuation-in-part of International Application No. PCT/DK2011/050041 titled "BELT TENSIONING MEANS INTEGRATED INTO ILLUMINATION DEVICE SHELL PART", with an international filing date of 11 Feb. 2011, now pending, which claims priority to Denmark Application No. DK PA 2010 0128, filed 16 Feb. 2010. This International Application and this Denmark Application are both hereby incorporated by reference in their entirety as though fully set forth herein.

FIELD OF THE INVENTION

The present invention relates to an illumination device comprising a base, a yoke connected to and rotatable relative to the base and a head connected to and rotatable relative to the yoke. The head comprises at least one light source generating light and the yoke comprises at least one yoke shell part and at least one motor connected to a bearing through a belt. The preset invention relates also to a method of manufacturing such illumination device.

BACKGROUND OF THE INVENTION

Moving head lighting fixtures are commonly known in the art of lighting and especially entertainment lighting. A moving head light fixture typically comprises a head having a number of light sources which creates a light beam and number of light effect means adapted to create various light effects. The head is rotatable connected to a yoke and the yoke is rotatable connected to a base and the result is that the head can rotate and direct the light beam in all directions.

The competition in the market has traditionally been based on the optical performance of the moving head such as light output, number of light effects, color mixing etc. The competition in the market has lately changed such that parameters such as quality, serviceability and price have become the most important factors. There is thus a need for a competitive moving head lighting fixture with regard to quality, serviceability and price.

US2009154165 discloses a device for influencing a light beam including a primitive element and a housing which is arranged on a rotatable arm and which is rotatable with respect to the primitive element by means of one of the several drive units, and into which a light source for generating a light beam may be introduced, wherein at least one part of the control electronics for operating the device is arranged in the rotatable arm or in the housing.

EP 1898145 discloses a moving head projectors comprising a base to which base a yoke is rotationally connected, which yoke is rotationally connected to a head, which head comprises a light source placed partly inside reflective means, which reflective means forms a light beam, which light beam passes through light forming means, which light beam furthermore passes through at least one lens before the light beam leaves the projector.

FR 2838178A discloses a spotlight having a face which supports a large number of red, green and blue light-emitting diodes which are controlled by an electronic circuit board at the rear to produce various color shades. The spotlight housing may be rotated about a horizontal axis by a motor and toothed belt and about a vertical axis by a motor and toothed belt.

EP 2103865 shows a system for rotating the head of a lighting fixture. A motor comprises a driving wheel, which driving wheel drives a belt, which belt 14 is kept tight by a belt tensioner. The belt tensioner comprises a fixture and a tensioner wheel, which fixture is held under tension by a spring. An absolute encoding module comprises an input wheel driven by the belt. The input wheel rotates a first axle, which first axle rotates a second axle at a different speed. Furthermore, the belt drives a wheel connected to a head.

The prior art moving heads comprise many components and are thus rather complicated to manufacture which increases the price of the moving head and further complicates the serviceability of the moving head.

DESCRIPTION OF THE INVENTION

The object of the present invention is to solve the above-described limitations related to prior art. This is achieved by an illumination device and method as described in the independent claims. The dependent claims describe possible embodiments of the present invention. The advantages and benefits of the present invention are described in the detailed description of the invention.

DESCRIPTION OF THE DRAWING

FIG. 1*a* is a perspective view and FIG. 1*b* is an exploded view;

DETAILED DESCRIPTION OF THE INVENTION

The present invention is described in view of a moving head lighting fixture including a number of LEDs that generate a light beam, however the person skilled in the art realizes that the present invention relates to moving head lighting fixture using any kind of light source such as discharge lamps, OLEDs, plasma sources, halogen sources, fluorescent light sources, etc.

Figure 1A:
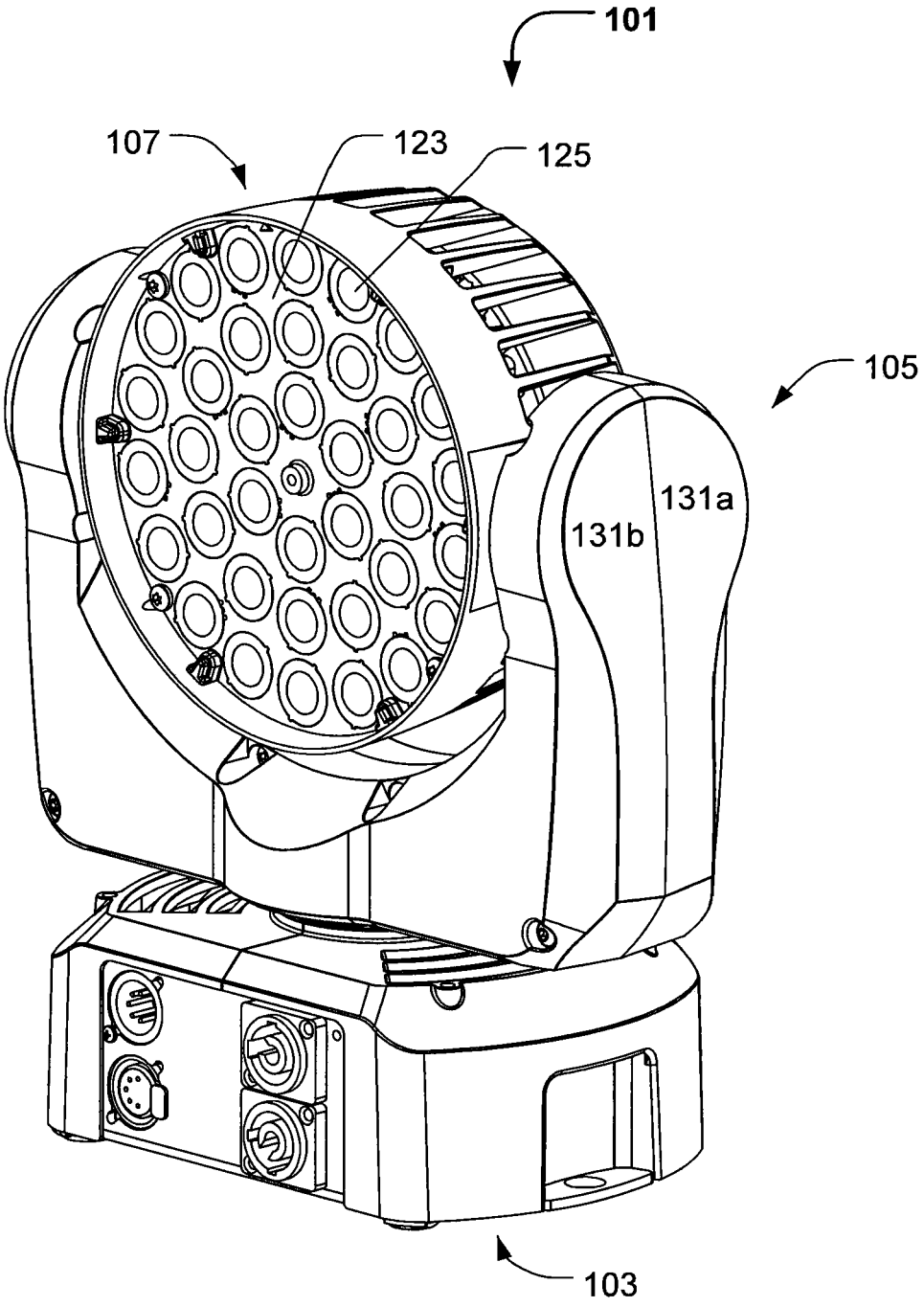
FIGS. 1*a* and 1*b* illustrate an illumination device according to one aspect of the present invention; where
Figure 1B:
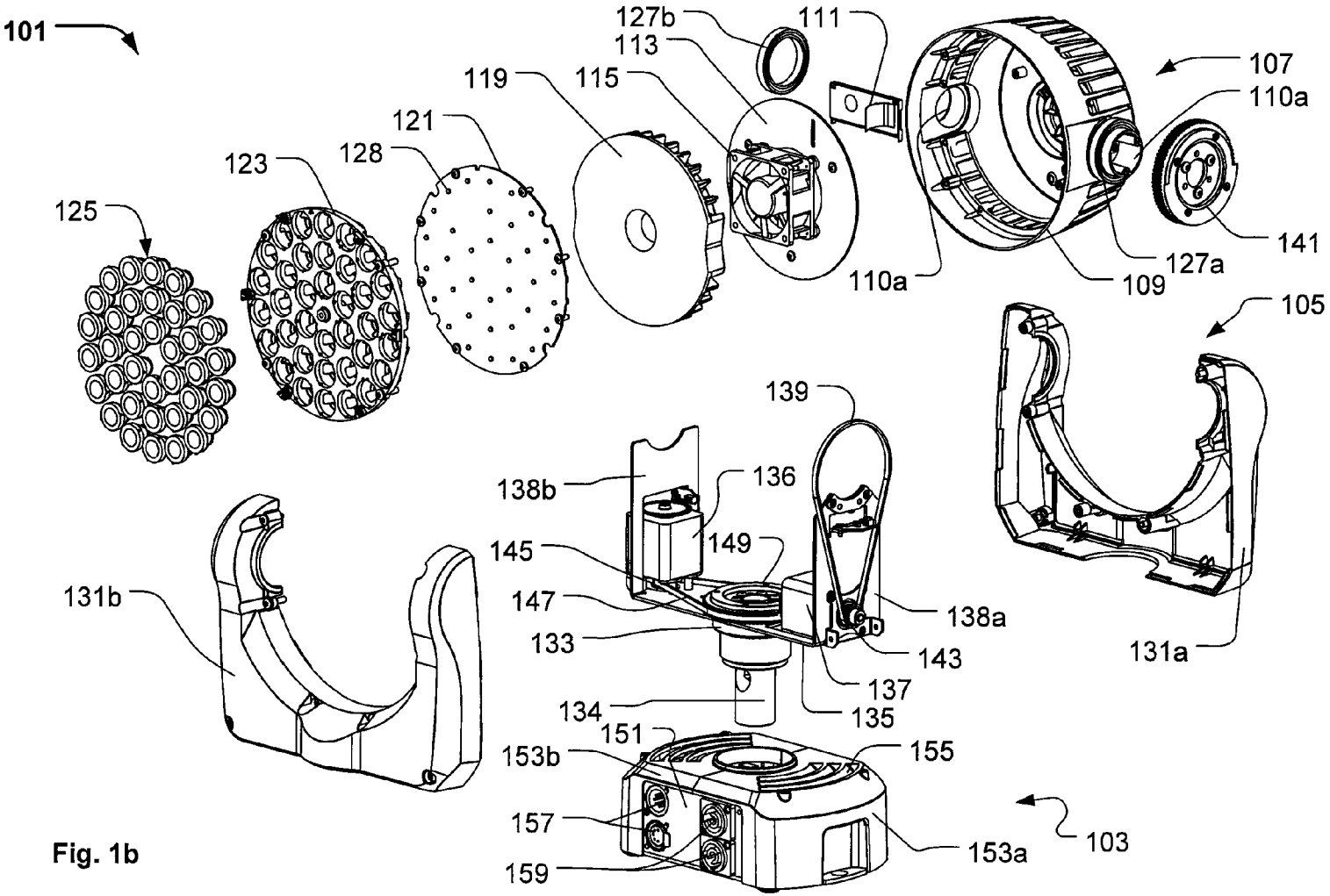

FIG. 1*a* and 1*b* illustrate an illumination device according to the present invention where FIG. 1*a* is a perspective view and FIG. 1*b* is an exploded view. The illumination device is a moving head lighting fixture 101 comprising a base 103, a yoke 105 rotatable connected to the base and a head rotatable connected 107 to the yoke.

In the illustrated embodiment, the head is embodied as a "bucket" shaped head outer shell 109 wherein a display 111, main PCB (Printed Circuit Board) 113, a fan 115, a heat sink 119, an LED PCB 121, a lens assembly are stacked. The lens assembly comprises a lens holder 123 and a lens array 125. However it it noticed that other components also may be arranged inside the bucket shaped outer shell and also that some of the mentioned components may be omitted. In this embodiment the bucket shaped head outer shell comprises two flanges 110*a* and 110*b* protruding outwards from the sides of the bucket shaped head outer shell. The head is rotatable connected to the yoke by two tilt bearings 127*a* and 127*b*, which are adapted to fit with the flanges and are supported by the yoke as described in connection with the yoke. The LED PCB 121 comprises a number of LEDs 128 emitting light and which in cooperation with the lenses 125 in the lens array generate a light beam. The main PCB comprises controlling circuits and driving circuits (not shown) for controlling the LEDs as known in the art of illumination devices. The main PCB comprises further a number of switches (not shown) which extend through a number of holes in the head outer shell 109. This makes it possible to assemble the head very fast, as the switches on the main PCB can be adapted to fit into holes at the bottom side of the bucket shaped outer shell and the switches will thus automatically be positioned correctly at the head. The same effect may be applied to the display 111. The switches and display act as a user interface allowing a user to communicate with the moving head lighting fixture. This relates to another aspect of the present invention where the head of a moving head light fixture comprises a number of light sources generating a light beam and an user interface allowing a user to communicate with the moving head light fixture using means for receiving user input form a user and means for providing visual feed back to the user. By placing the means for receiving user input and the means for providing visual feedback at the head makes it possible for a user to access and communicate with the moving head light fixture from many positions around the moving head light fixture, as the head can be moved such that the user interface may turn towards the user. This is advantageous over the prior art where the interface is position at base which is often fixed to a rig and thus not movable whereby the user must move in relation the light fixture which can be very difficult and dangerous in huge rigs. It is also advantageous over the prior art moving head light fixtures where the user interface is positioned at the yoke, as the yoke only can rotate in relation to the base which limits the positions in which the user interface can be positioned. For instance when such moving heads been positioned very closely in a matrix it is almost impossible to access a user interface at the yoke or at the base for the moving head fixtures positioned in the middle of the matrix. The moving head according the one aspect of the present invention solves this as the means for receiving user input and the means for providing visual feedback is integrated into the head whereby it can be turned against the user even if the moving head is positioned very closely in a matrix. In the illustrated embodiment the means for receiving user input is embodied as a number of switches accessible from the outside of the head and the means for providing visual feedback is embodied as a display adapted to display relevant information to the user. However it is to be understood that the means for receiving user input can be embodied as any means capable of receiving user input and converting the user input to signals which can be interpreted by a processor. The user input can for instance be switches, keyboards, pointers, touchpads, joysticks, strollers. Further it is to be understool that the means for prociding visual feedback can be embodied as any means cable of providing visual feedback from a processor to the user. The means for providing visual feedback can for instance be embodied as a number of status LEDs (or other light sources) indicating the status of the light fixture or any kind of display capable of providing information to the user such as pixel based displays, segmental displays. Another alternative it to integrate the means for visual feedback into the light sources generating a light beam and activating these differently in order to indicate different status of the moving head light fixture; for instance by changing color, strobing or any other pattern which can be recognized by a user. The means for receiving user input and providing visual display can also be integrate as a touch screen where the user can use the display as a touch pad and there through communication with the moving head light fixture.

The yoke 105 comprises two yoke shell parts 131*a* and 131*b* that are interlocked across the entire width of the yoke. Compared to the yoke of prior art moving head lighting fixtures this yoke can be manufactured very fast and thereby reduce the price of the moving head lighting fixture. The two yoke shells 131*a* and 131*b* are interlocked across the entire width of the yoke along an edge, meaning that the two yoke shell parts are brought together in a locked position where the yoke shell parts have at least one pair of edges that are positioned adjacent to each other whereby the yoke shells form a tight enclosure and adds static strength to the construction. The yoke shell parts can be interlocked by fastening means such as screws, adhesive, or other kinds of engaging means. The entire width may be defined as the cross section having the largest dimension. This provides a stiff yoke construction as the yoke shell parts are interlocked over a large dimension. The manufacturing process of this yoke is very fast since the components, which are to be positioned within the yoke, can be arranged in a first yoke shell part 131*a* whereafter the second yoke shell part 131*b* can locked to the first yoke shell part 131*a*. The yoke shell parts form a monocoque shell which supports at least a part of the structural load provided to the yoke. The strength of the interior yoke (metal) structure, which normally takes up the entire structural load in prior art yokes, can thus be reduced for instance by providing simpler structures or by reducing the thickness of the (metal) structure. The interior yoke structure can even in some embodiment be completely omitted. The cost of the interior yoke structure can thus be reduced as a simpler structure can be provided and less material is needed in order to provide proper support of the yoke. The yoke shell parts 131*a* and 131*b* further fit together across the entire width of the yoke whereby it is easier to ensure that the yoke shell parts are locked together in a proper way. This can for instance be achieved by providing engaging means which ensure that the yoke shell parts only can be locked together in one particular way. The engaging means used in the illustrated embodiment can be seen in FIGS. 3*a* and 3*b*. This decreases the probability that the yoke shell parts are mounted wrongly which increases the quality of the product. The yoke shell parts can further be identical which decreases the costs even more as only one molding tool is needed and the manufacturing process is further simplified as there is no need to keep track of two different yoke shell parts.

The yoke shell parts are further connected to a pan bearing 133 rotatable connected to the base 103 through a shaft 134. The yoke comprises in this embodiment a metal frame 135 whereto a pan motor 136 and tilt motor 137 are arranged. The tilt motor 137 is arranged on a first arm 138*a* of the metal frame and connected to the tilt bearing 127*a* through a tilt belt 139. Tilt bearing 127*a* comprises further a toothed wheel 141 which is fixed to the rotating part of tilt bearing 127*a* and the head 107. The tilt motor comprises also a toothed wheel 143 and the tilt belt 139 is connected to the toothed wheel 141 of the tilt bearing and the toothed wheel 143 of the motor. The tilt belt comprises also a number tooth (not shown) which is adapted to engage the toothed wheels 141 and 143. The tilt motor will as a consequence be able to rotate the head in relation to the yoke. It is to be understood that the tilt belt connection between the tilt motor and tilt bearing also can be embodied without the use of engaging teeth.

The pan motor 136 is arranged on a second arm 138*b* of the metal frame 135 and connected to the pan bearing 133 through a pan belt 145. The pan bearing and pan motor both comprise a toothed wheel (145 and 147 respectively) interconnected by a toothed pan belt 149. The toothed wheel 145 of the pan bearing is fixed in relation to the base 103 and the pan motor can thus rotate the yoke in relation the base. The metal frame makes it possible to mount the components which are to be positioned inside the yoke, such as pan motor, tilt motor, pan bearing, tilt bearing and other electronic or mechanical devices, before mounting the yoke shell parts. The metal frame is a bent one-sheet metal plate which reduces costs since the metal frame can be bent by a machine as known in the art of metal production. The skilled person will however realize that the metal frame can be omitted in other embodiments and that the components which are to be positioned inside the yoke can be mounted directly onto the yoke shell parts prior to locking the yoke shell parts together. This can for instance be achieved by providing mounting guides such as flanges, spacers or holes in the yoke shell parts. The mounting guides can for instance be molded as a part of the yoke shell parts.

The base 103 comprises a one-sheet metal main base frame 151 and two base shell parts 153*a* and 153*b*. The two base shell parts are arranged on the metal main base frame and have vent holes 155 on top for air cooling. The base further comprises 5-Pin XLR male and female connectors 157 for DMX signals as known in the art; input and output power connectors 159, power supply PCB's (not shown) and fan (not shown).

Figure 2:
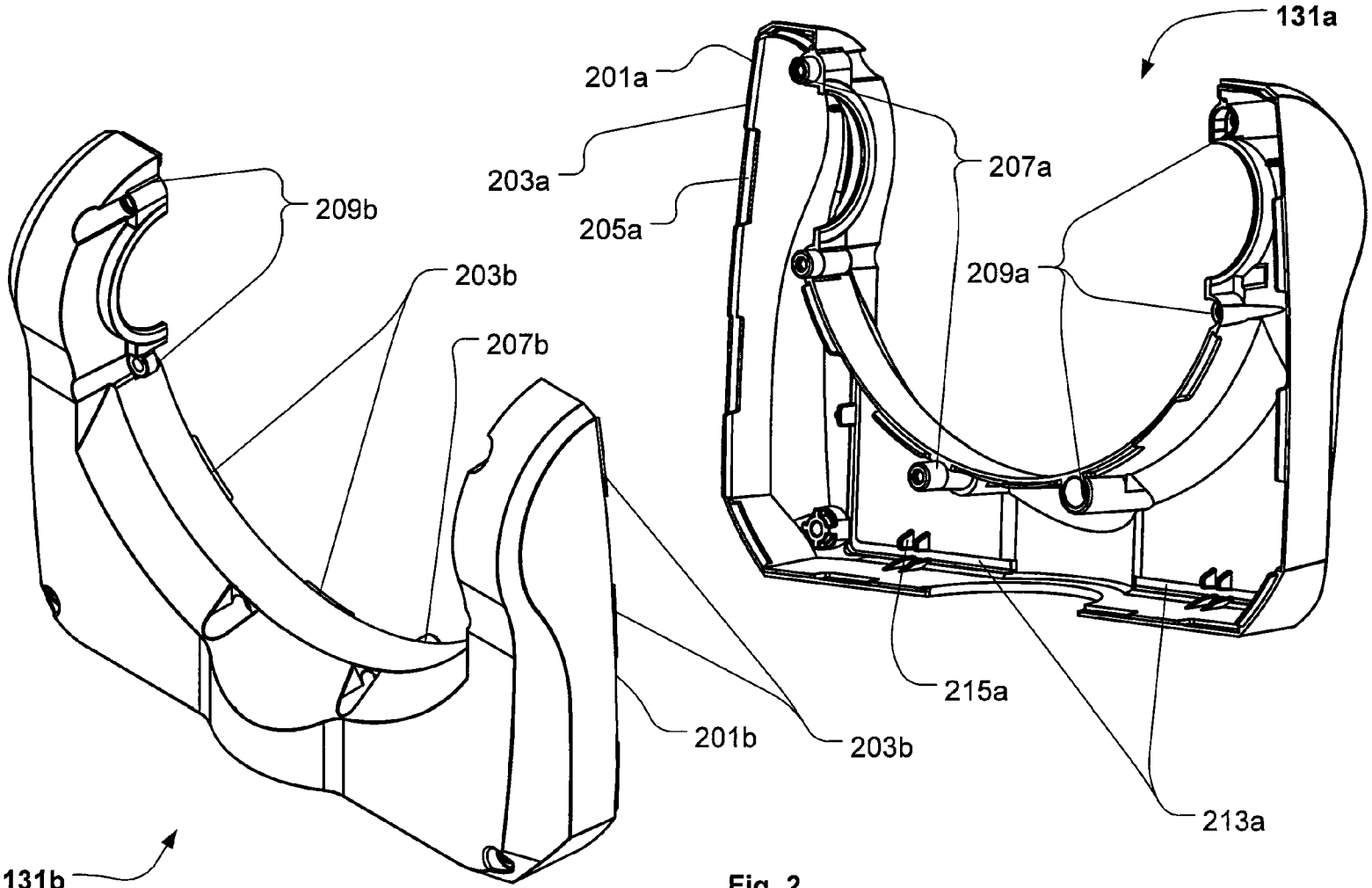
FIG. 2 illustrates a perspective view of two yoke shell parts 131*a* and 131*b* used in the illumination device in FIG. 1*a* and 1*b;*

FIG. 2 illustrates a perspective view of the two yoke shell parts 131*a* and 131*b*. The yoke shell parts are molded in a plastic material and are identical, which reduces manufacturing costs as only one molding tool is needed. The yoke shell parts 131*a* and 131*b* are interlocked along a locking edge 201*a* and 201*b* of each yoke shell part. The locking edge extends across the entire width of the yoke. The entire width may be defined as the cross-section having the largest dimension. This provides a stiff yoke construction as the yoke shell parts are interlocked over a large dimension. The stiffness of the construction is further increased due to the fact the locking edges 201*a* and 201*b* comprises at least two locking edge parts which are perpendicular to each other, as the bottom part of the yoke shell parts are substantially horizontal (with respect to the base) and the arm parts of the yoke shell parts are substantially vertical (with respect to the base). The monocoque shell constituted by the two yoke shell parts is thus capable of supporting structural loads applied to the yoke and also resist twisting and bending.

The yoke shell parts comprise engaging means adapted to engage with the other interlocked yoke shell part. The engaging means function as guides which ensure that the two yoke shell parts only can be locked together in the correct way. In the illustrated embodiment, the engaging means are embodied as a number of flanges 203*a* and 203*b* protruding from the locking edges 201*a* and 201*b* respectively. The flanges are adapted to engage with a corresponding number of recesses 205*a* (the recesses of yoke shell part 131*b* is not visible) in the locking edge of the other yoke shell parts. In the illustrated embodiment, the protruding flanges and recesses are positioned asymmetrically around the center of the yoke such that each flange will engage with an opposite recess when the two yoke shell parts are positioned with the locking edges 201*a* and 201*b* in front of each other. The engaging means are further embodied as number of bosses 207*a* and 207*b* protruding from the locking edges 201*a* and 201*b* respectively and a corresponding number of mating bores 209*a* and 209*b* integrated in the locking edges 201*a* and 201*b* respectively. The bores are further adapted to accommodate screws which are tightened into the boss e.g. into a threaded hole or by forcing the screw directly into the boss.

The yoke shell parts comprises also bearing guiding means embodied as an arc-shaped flange 211*a* and 211*b*. The bearing guiding means are adapted to hold the tilt bearing when the yoke shell parts are interlocked and functions further as a belt tensioning means as explained in connection with FIG. 4*a*-4*c*. Other embodiments of possible belt tensioning means are described in connection with FIG. 4-6.

The yoke shell parts comprise mounting guiding means adapted to support at least one component positioned within said yoke. The mounting guiding means can for instance be embodied as flanges, bosses, recesses or bores integrated into the internal side of the yoke shell part. The components can for instance be attached to these parts by using fastening means such as screws, adhesives, snap mechanisms etc. Mounting guiding means can also be shaped as partial cavities shaped to accommodate the components which are to be positioned inside the yoke. The illustrated yoke shell parts comprise mounting guiding means in the form of a recess 213*a* for accommodating the metal frame (shown in FIG. 1*b*), mounting guides such as a recess for accommodating the metal frame and a number of flanges 215*a* supporting the metal frame. The recess and flanges simplify the manufacturing process, as they make it very easy to position the metal frame in the yoke shell part.

Figures 3A, 3B:
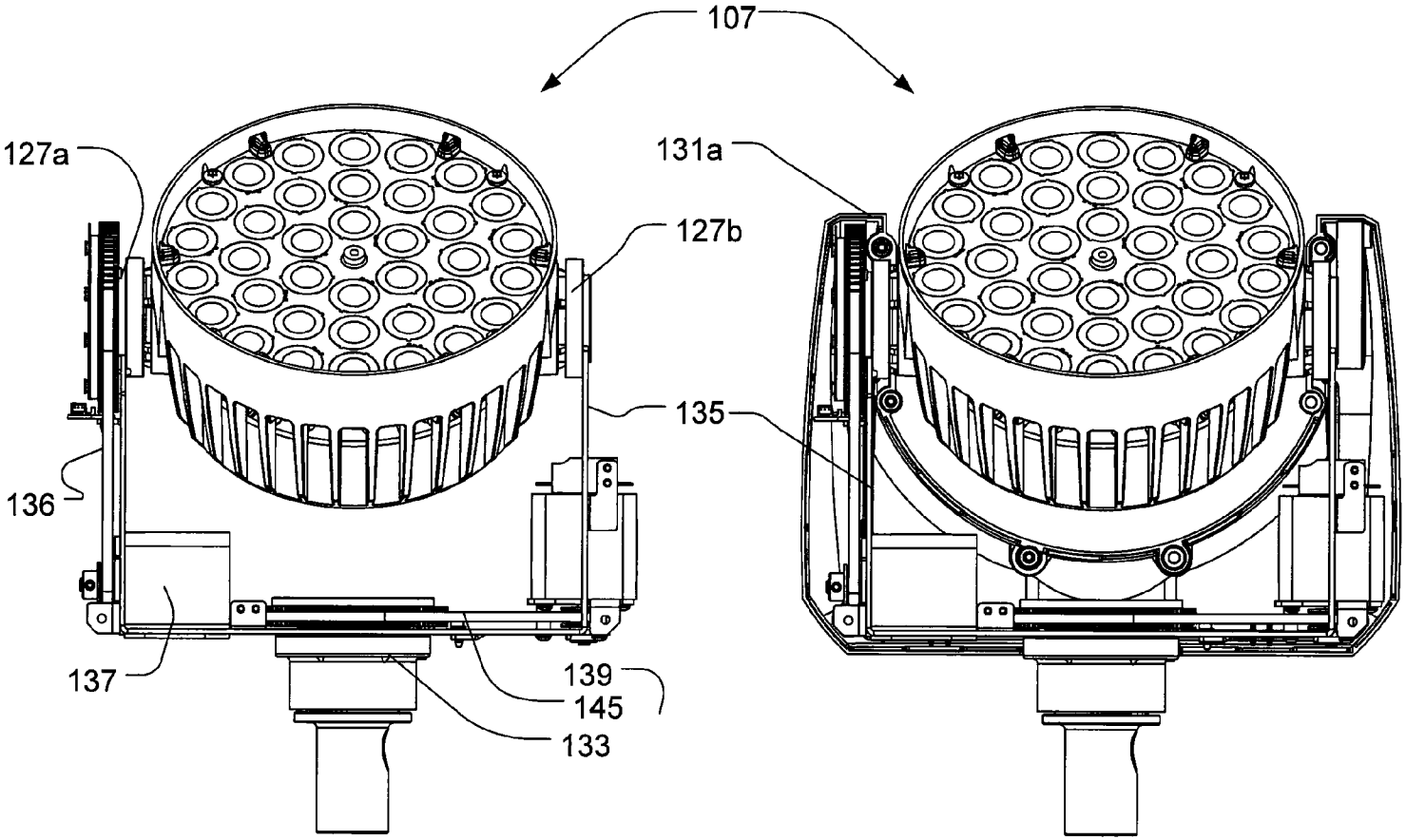
FIG. 3*a*-3*b* illustrate steps of manufacturing the illumination device of FIG. 1*a* and 1*b;*
Figures 4A, 4B, 4C:
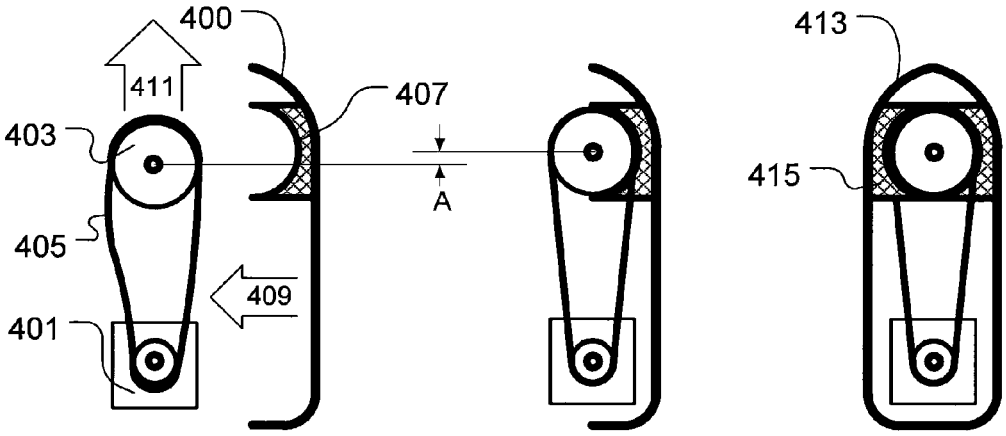
FIG. 4*a*-4*c* illustrate a first embodiment of a yoke shell part comprising belt tensioning means.

A method of manufacturing an illumination device like the illumination device illustrate in FIG. 1*a* and 1*b* can comprise the steps of providing the base, providing the yoke and providing the head. FIGS. 3*a* and 3*b* illustrate the step of providing the yoke. FIG. 3*a* illustrates that the pan motor 136 is mounted to one yoke arm and the pan bearing 133 to the bottom part of the metal frame whereafter they are connected by the pan belt 145. The tilt motor 137, tilt bearing 127*a* and tilt belt 139 are mounted on one arm of the metal frame and a second tilt bearing 127*b* is mounted on the other arm of the metal frame. The tilt bearings 127*a* and 127*b* are arranged on top of the metal frame arm, and the tilt belt 139 is connected to the tilt motor 137 and the tilt bearings 127*a*. FIG. 3*b* illustrates that at least one component can be arranged within at least one of the yoke shell parts prior to locking the two yoke shell parts together. In the illustrated embodiment this is embodied by mounting the first yoke shell part 131*a* on the metal frame 135, whereby the metal frame is arranged at least partially within the first yoke shell part 131*a*. The yoke shell part comprises belt tensioning means embodied as tilt bearing guiding means which are adapted to engage with the tilt bearings and lift the tilt bearing up from the metal frame. In the illustrated embodiment, the tilt bearing is only lifted a few millimeters and FIG. 4*a*-4*b* illustrate a simplified drawing of this functionality. The tilt belt is hereby tensioned and the tilt motor can rotate the tilt bearing and thus also the head in relation to the yoke. This reduces mounting time as the step of tensioning the tilt belt is performed as a part of the step where the first yoke shell part is mounted on the metal frame. The bearing guiding means are embodied as a number of arc-shaped flanges which are adapted to partly encircle the tilt bearing. The center of the arc-shaped flange is arranged higher in relation to the metal frame than the center of the tilt bearings in relation the metal frame, when the tilt bearing is arranged on the metal frame. Thus the tilt belt will automatically be tightened when the first yoke shell part is mounted on the metal frame. This functionality is illustrated in further detail in FIG. 4*a*-4*c*. A belt tensioning device as known in the art (for instance as disclosed in EP2103865A) can thus be eliminated, whereby both savings on the components and mounting time are achieved. The method of manufacturing comprises also the step of locking the second yoke shell part to the first shell part, whereby the yoke appears as illustrated in FIG. 1*a*. The two yoke shell parts constitute now a monocoque shell which takes up at least a part of the structural load provided to the yoke. The second yoke shell comprises also tilt bearing guiding means which serve the same function as the tilt bearing guiding means of the first yoke shell part and thus secure the tilt bearing in a position where the tilt belt is held under tension.

FIGS. 4-6 illustrate an illumination device according to the present invention and illustrate principles of different embodiment of possible belt tensioning means which can be integrated into the yoke shell part and adapted to tension a belt connecting a motor and a bearing upon mounting of the yoke shell part on the yoke. FIGS. 4-6 illustrate the principles behind the belt tensioning means and show a cross-sectional view of a yoke. It is to be understood that some components may be omitted for simplicity. The principles in FIGS. 4-6 is illustrated as belt tensioning means for a tilt drive comprising a tilt motor 401, a tilt bearing 403 and a tilt belt 405. The tilt drive is embodied in a yoke and adapted to rotate a head (not shown) in relation to the yoke. It is to be understood that similar principles can be used for any motor, bearing and belt systems, for instance a pan drive adapted to rotate the yoke in relation the base.

FIGS. 4*a*-4*c* illustrate a yoke shell part where the belt tensioning mechanism is formed as bearing guiding means adapted to displace the bearing in relation to a motor upon mounting the yoke shell part 400 to the yoke. FIG. 4*a* illustrates the setup prior mounting the yoke shell part 400, FIG. 4*b* illustrates the setup after the yoke shell part 400 has been mounted on the yoke, and FIG. 4*c* illustrates the final setup. A tilt motor 401, a tilt bearing 403 and a tilt belt 405 are, in FIG. 4*a*, arranged in relation to each other such that the tilt belt is loosely looped around the tilt motor and the tilt bearing. The tilt belt, tilt motor and tilt bearing can for instance be arranged on a metal frame (not shown) as described above or arranged in another yoke shell part (not shown). The tilt motor comprises an axis which can be rotated by the motor, as known in the art. The tilt bearing is arranged such that it is possible to displace the tilt bearing in relation to the tilt motor for instance by positioning the tilt bearing on top of a metal frame as described above. The tilt bearing can also be mounted in a mechanical guide such as a guiding slot wherein the tilt bearing can move in relation the tilt motor. The bearing guiding means is formed as an arc-shaped flange 407 which is integrated as a part of the yoke shell part 400. The yoke shell part 400 is mounted on the yoke in a direction indicated by arrow 409 and the arc-shaped flange will engage with the tilt bearing and force the tilt bearing 403 in an upward direction as indicated by arrow 411 due to the shape of the flange. The tilt bearing is thus displaced a distance A in relation to the tilt motor whereby the tilt belt 405 is tensioned as illustrated in FIG. 4*b*. A second yoke shell part 413 is mounted and locked to yoke shell part 400 in FIG. 4*c*. The skilled person realizes that the bearing guiding means alternatively can be a curved surface that engages with the tilt bearing. The second yoke shell part comprises also bearing guiding means formed as an arc-shaped flange 415 which is integrated as part of the yoke shell part 413. The bearing guiding means 415 of the second yoke shell part secures the tilt bearing in the position where the tilt belt is tight.

Figures 5A, 5B, 5C:
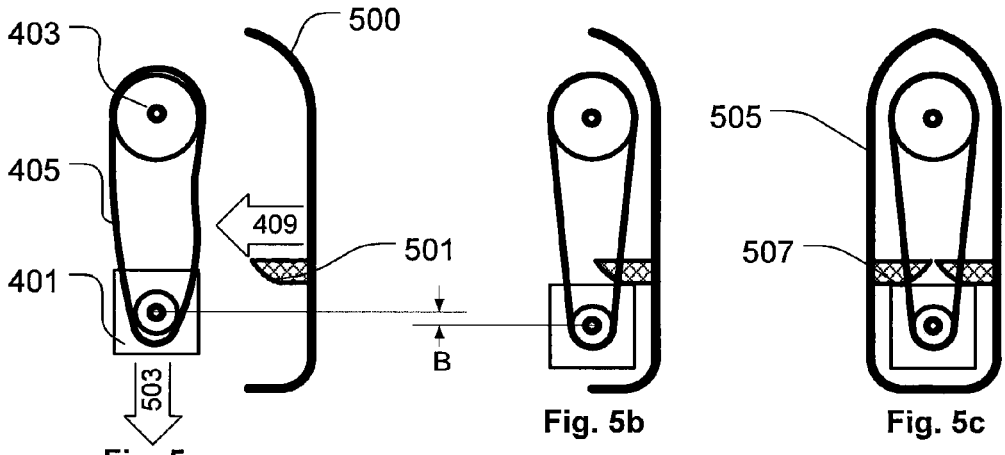
FIG. 5*a*-5*c* illustrate a second embodiment of a yoke shell part comprising belt tensioning means.
Figure 6A:
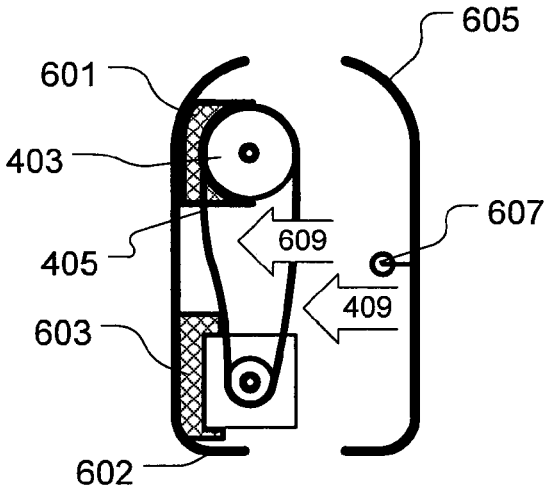
FIGS. 6*a* and 6*b* illustrate a third embodiment of a yoke shell part comprising belt tensioning means.
Figure 6B:
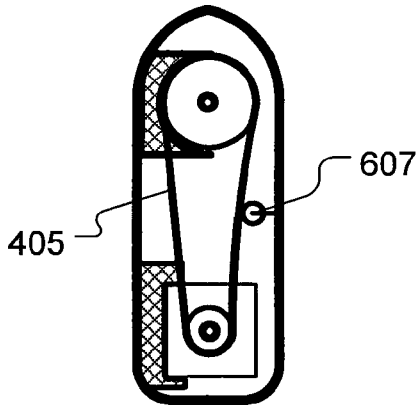

FIG. 5*a*-5*c* illustrate a yoke shell part where the belt tensioning mechanism is formed as motor guiding means adapted to displace the motor in relation to a bearing upon mounting the yoke shell part to the yoke. FIG. 5*a* illustrates the setup prior mounting the yoke shell part 500; FIG. 5*b* illustrates the setup after the yoke shell part has been mounted on the yoke and FIG. 5*c* illustrates the final setup. In this embodiment the tilt motor is arranged such that it is possible to displace the tilt motor in relation to the tilt bearing for instance by arranging a part of the tilt motor in a mechanical guide such as a guiding slot wherein the tilt motor can move in relation the tilt bearing. The motor guiding means is formed as a curved flange 501 which is integrated as part of the yoke shell part 500. The yoke shell part 500 is mounted to the yoke in a direction indicated by arrow 409 whereby the curved flange 501 will engage with the tilt motor 401 and force the tilt motor in a downward direction as indicated by arrow 503 due to the shape of the curved 501 flange. The tilt motor is thus displaced a distance B in relation to the tilt bearing whereby the tilt belt 405 is tightened as illustrated in FIG. 5*b*. In FIG. 5*c* a second yoke shell part 505 is mounted on and locked to yoke shell part 500. The second yoke shell part 505 comprises also motor guiding means formed as a curved flange 507 which is integrated as part of the yoke shell part 505. The motor guiding means 507 of the second yoke shell part helps secure the motor in a position where the tilt belt is tight FIGS. 6*a* and 6*b* illustrate a setup where the tilt bearing 403 and tilt motor 401 are arrange in a first yoke shell part 601 using mounting guiding means 602 and 603, where guiding means 602 is adapted to accommodate the tilt bearing and guiding means 603 is adapted to accommodate the tilt motor 401. The mounting guiding means can be molded as part of the first yoke shell part 601 and formed to accommodate the tilt motor and tilt bearing. The guiding means can also include a snap mechanism adapted to hold the tilt motor or the tilt bearing in the mounting guiding means. In this embodiment the belt tensioning mechanism is formed as belt guiding means adapted to displace least a part of the belt upon mounting the yoke shell part 605 on the yoke. The belt guiding means are embodied as a pulley 607 connected to the yoke shell part 605. The pulley is adapted to displace a part of the tilt belt as indicated by arrow 609 by pushing to the tilt belt when the yoke shell part is mounted as indicated by arrow 409. The displacement of the tilt belt results in the fact that the path which the tilt belt follows when rotating is increased and the tilt belt is as a consequence tensioned as illustrated in FIG. 6*b*. The pulley ensures that the tilt belt can rotate without much friction, however, the skilled person realizes that the belt tensioning effect also can be achieved by a fixed mechanical mechanism without pulley. The pulley can also be spring-mounted on the yoke shell such that constant pressure is applied to the tilt belt.

Figure 10A:
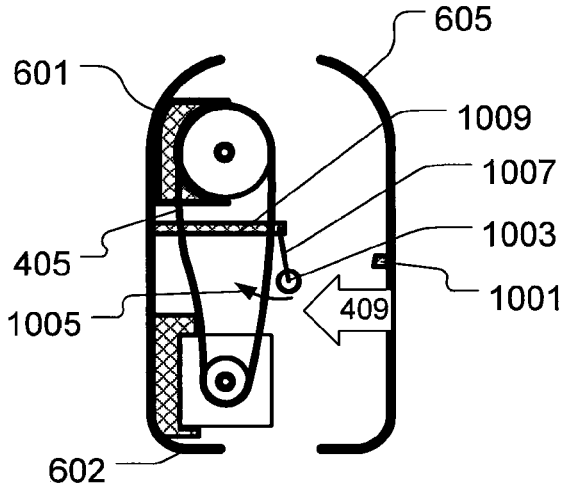
FIGS. 10*a* and 10*b* illustrate a fourth embodiment of a yoke shell part comprising belt tensioning means.
Figure 10B:
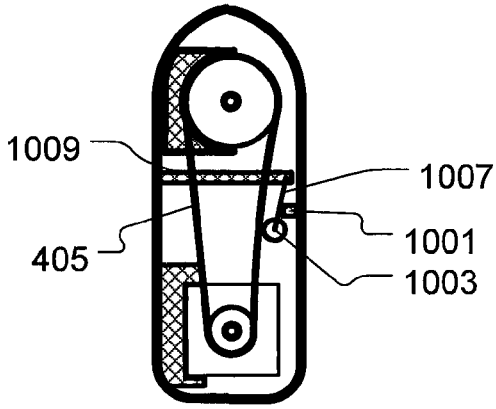

FIGS. 10*a* and 10*b* illustrate a setup similar to the one in FIG. 6*a* and FIG. 6*b* except for the fact that the belt guiding means are embodied as a protrusion 1001 inside the second yoke shell part 605. The protrusion 1001 is adapted to interact with a rotatable pulley 1003 connected to the first yoke shell part 601. The pulley displaces a part of the tilt belt as indicated by arrow 1005 by pushing on the tilt belt when the protrusion 1001 interacts with the pulley upon mounting of the yoke shell part 605 as indicated by arrow 409. The pulley 1003 is mounted on an arm 1007 which is rotatable connected to mounting guide 1009 of the yoke shell part 605. It is to be understood that the rotating pulley can be spring-loaded and also be arranged on a metal frame like the one illustrated in FIG. 1*b*.

It is to be understood that any combination of the principles illustrated in FIGS. 4-6 and 10 can be combined. The yoke shell part including belt tensioning means is illustrated in FIGS. 4-6 and 10 in connection with the a yoke which is covered by two yoke shell parts. However it is further to be understood that the principles of the belt tensioning means also can be use in connection with yokes where the yoke shell parts that comprise the belt tensioning means only covers a part of the yoke and in connection with yokes where the yoke shell parts do not support a part of the structural load applied to the yoke.

It is to be understood that the principles of the belt tensioning mechanism integrated into the yoke shell part also can be used in an illumination device comprising a light source generating a light beam where the illumination device comprises at least one housing, and where the at least one housing comprises an outer shell comprising a number of shell parts surrounding at least one motor connected to a bearing through a belt wherein said at least one of the shell parts comprises belt tensioning means adapted to tighten said belt upon mounting of the shell part to the housing. The housing can for instance be an outer housing surrounding most of the components in the illumination device. The housing can also be a modular housing functioning as an internal housing surrounding a part of the components in the illumination device. The modular housing can for instance be a zoom system where a number of optical lenses are adapted to move along an axis for instance by using a motor belt mechanism whereby this belt mechanism can for instance be tightened by a belt tensioning mechanism integrated in a shell part surrounding at least a part of the components in the zoom module.

Figure 7A:
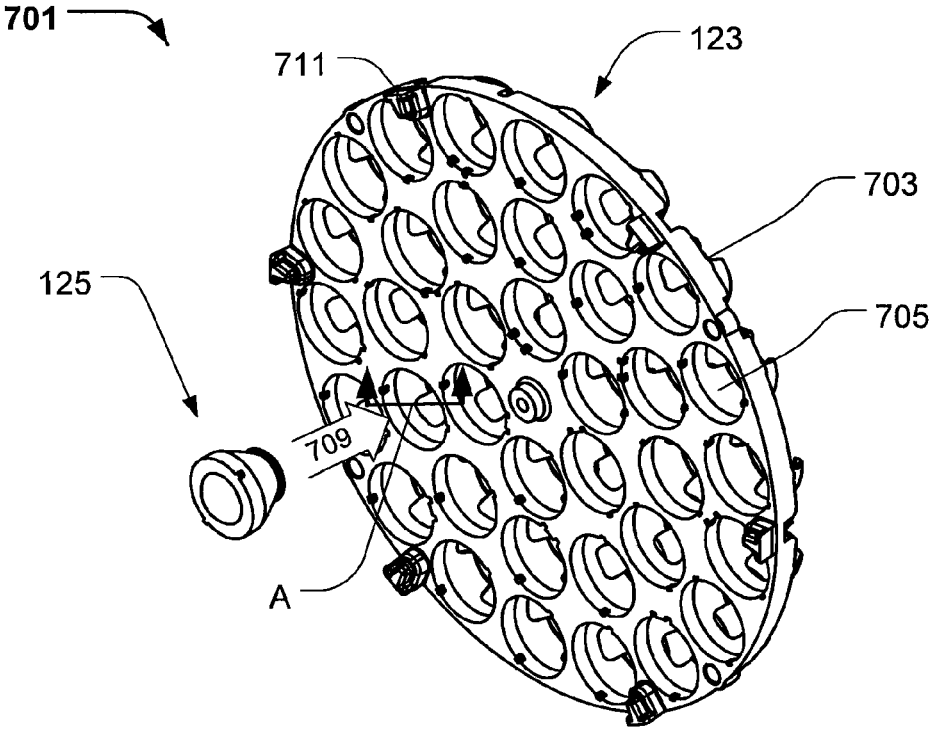
FIG. 7*a* and FIG. 7*b* illustrate a lens assembly according to one aspect of the present invention.
Figure 7B:
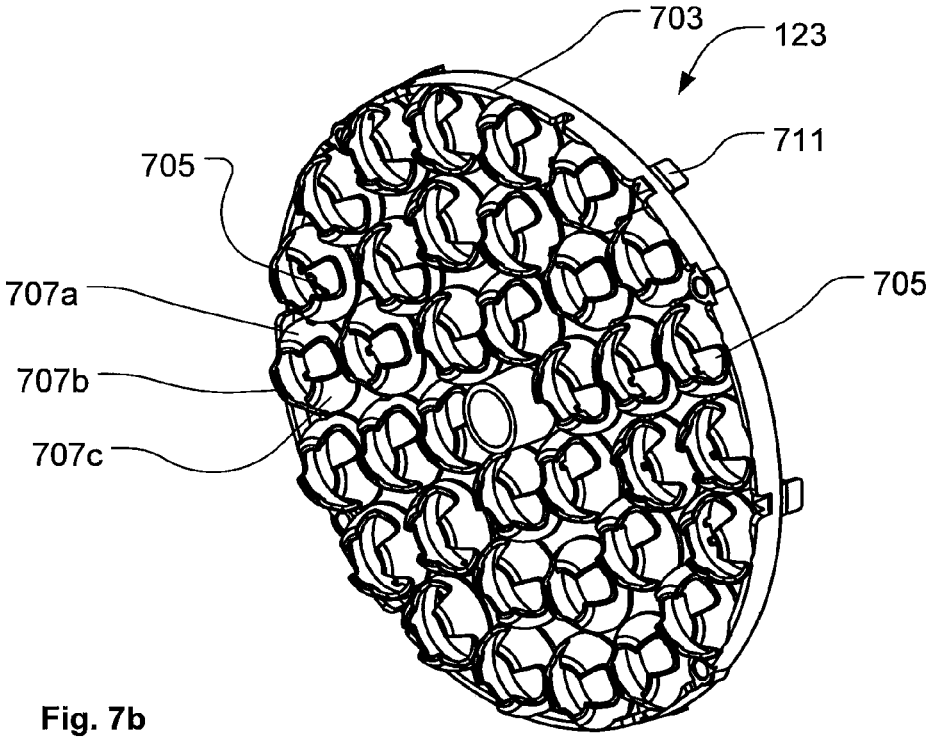

FIGS. 7*a* and 7*b* illustrate respectively a front and back perspective view of a lens assembly 701 used in the illumination device 101 illustrated in FIG. 1-3. The lens assembly comprises a number of optical lenses 125 (only one is shown for simplicity) and a lens holder 123. The lens holder comprises a mounting plate 703 having a number of holes 705 where the holes are adapted to accommodate the lenses. The lens holder comprises further a number of resilient fingers extending backward from the mounting plate and at least partially surrounding the holes. The resilient fingers will thus extend towards the light sources when the lens assembly is arranged above light sources. In the illustrated embodiment each hole is surrounded by three resilient fingers 707*a*-707*c* positioned at 120-degree intervals around the hole. The resilient fingers are adapted to engage with the lenses and secure the lenses in the holes. The lenses can as a consequence be arranged very quickly in the holes as the resilient fingers will automatically engage with the lens and secure the lens. It is to be understood that any number of resilient fingers can be used. Arrow 709 illustrates that the lens 125 can simply be inserted from the front of the lens holder. The lens holder can as a consequence be mounted onto the PCB prior to mounting the lenses which simplifies the manufacturing process since there is no need to mount a lens holder for each lens, as in prior art illumination devices. The lenses are further tightly secured as the resilient fingers 707 engage with the lenses over large areas and the lenses are hereby held in the same position even though the head of the illumination devices rotates. The resilient fingers will further not influence the outgoing light from the front of the lens as they engage with the rear side of the lens holder. In the case of TIR (Total Internal Reflection) lenses, the resilient fingers will not influence the light as they engage with the outer side of the surface were the total internal reflection takes place. The tolerance requirements related to this lens assembly are further not as strict as prior art lens holders where the lens is secured by flanges holding the front of the lens on the front side of the mounting plate. This reduces costs as the manufacturing of each component is not subject to the same strict tolerances as prior art lens assemblies. The lens holder also comprises a number of front plate/sheet supports 711 which are adapted to hold and support a front plate. A front plate/sheet can therefore be arranged in front of the lens assembly. Said front plate/sheet can for instance be formed as an additional lens part, a diffuser plate/sheet, textured glass or a color filter. The costs related to the manufacturing of such a lighting assembly are further reduced compared to prior art lighting assemblies, as both the lenses and the lens holder can be constructed by using known molding techniques.

Figure 8A:
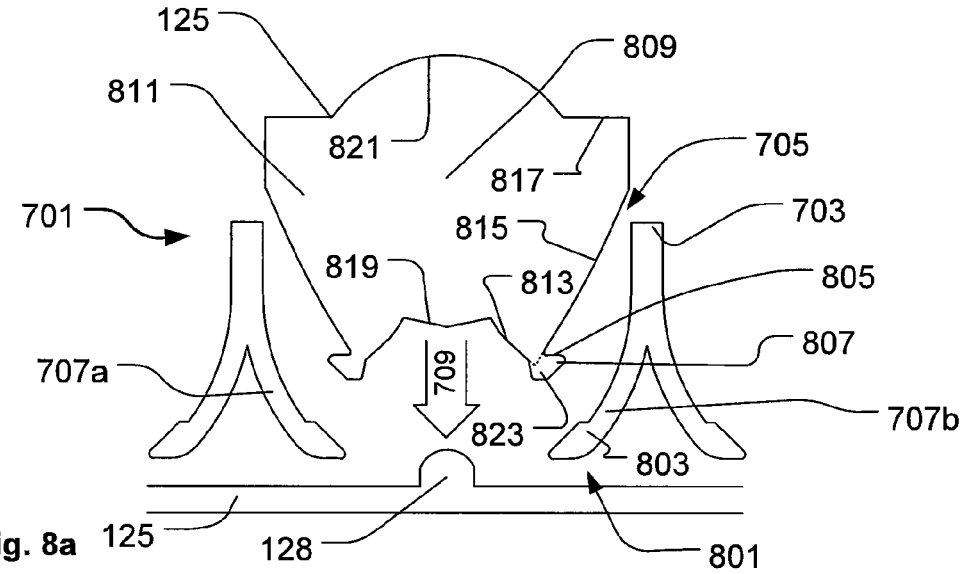
FIG. 8*a*-8*c* illustrate a cross sectional view along line A of the lens assembly in FIG. 7*a;*
Figure 8B:
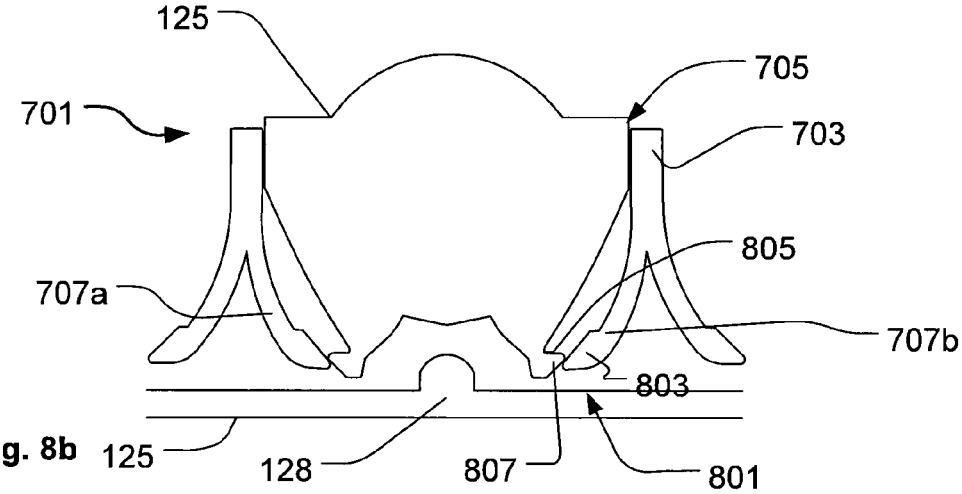
Figure 8C:
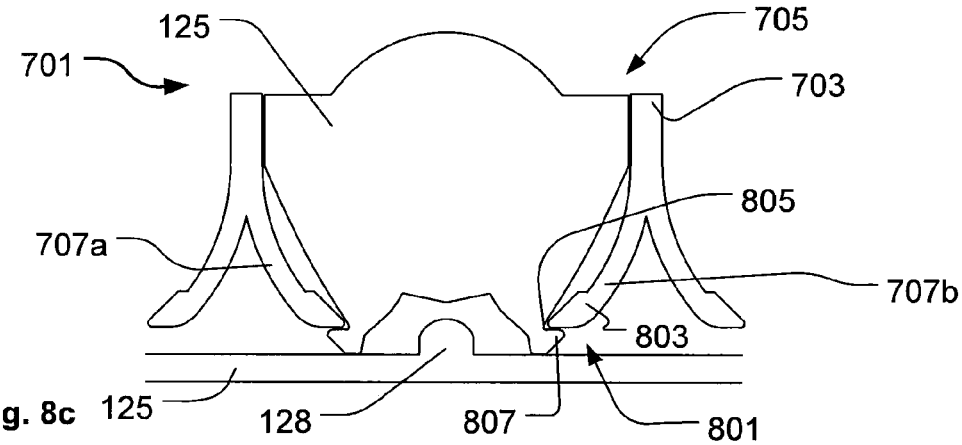

FIG. 8*a*-8*c* illustrate a cross-sectional view along line A of the lens assembly in FIG. 7*a* and illustrate how a lens 125 can be arranged in the lens holder 701. FIG. 8*a* illustrates the lens holder 701 and lens 125 before the lens is arranged in the hole, FIG. 8*b* illustrates an intermediate situation and FIG. 8*c* illustrates the final situation. The lens holder 701 is positioned above the LED PCB 121 and arranged such that the lens 125 will be arranged above an LED 128 when it is arranged in the lens holder. FIG. 8*a* illustrates that the lens 125 is inserted into the lens holder 701 from the front side as illustrated by arrow 709. The resilient fingers 707*a* and 707*b* in their neutral state are angled towards the center of said hole 705, meaning that they will bend towards the center of the hole when no force is applied to the resilient fingers. FIG. 8*c* illustrates that the hole 705 is adapted to accommodate the lens and support the top part of the lens. The resilient fingers engage with the lens through an engagement mechanism 801 comprising a first mating portion integrated into the resilient fingers 803 and a second mating portion 805 integrated into the lens. The tips of the resilient fingers constitute the first mating portion and the second mating portion 805 comprises flange 807 transversally protruding from the lens. The transversally protruding flange 807 will in the intermediate situation illustrated in FIG. 8*b* come into contact with the tip of the resilient fingers and apply a force to the resilient fingers. The resilient fingers will as a consequence bend away from their neutral state and allow the transversally protruding flange 807 to pass. The transversally protruding flange and tips of the fingers will engage once the transversally protruding flange has passed the tip of the resilient fingers, and in this position the transversally protruding flange 807 and the resilient fingers 707*a* and 707*b* are adjacent to each other. The lens is formed such that the cross-sectional dimensions of the lens decrease in a direction backwards from said front plate. The tip of the resilient fingers will as a consequence be locked by the transversally protruding flange 807 and the edges of the lens.

The lens is as illustrated in FIG. 8*a* a light collector which collects light emitted from the LED 128 and converts the collected light into a light beam. The light collector comprises a central lens part 809 aligned along the optical axis of the LED and a peripheral lens part 811 surrounding at least a part of the central lens 809. The peripheral lens part comprises a peripheral entrance surface 813, a peripheral reflection surface 815 and a peripheral exit surface 817. The peripheral part of the light emitted by the light source enters the peripheral lens part through the peripheral entrance surface and is reflected by the peripheral reflection surface before leaving the peripheral lens through the peripheral exit surface 813. The central lens part comprises a central entrance surface 819 and a central exit surface 821. A central part of the light 823 emitted by the light source enters the central lens through the central entrance surface 819 and leaves the central lens through the central exit surface 821. The lens 125 can be formed to create a light beam having a desired beam divergence for instance a positive beam divergence in order to create a wide light beam, a substantially zero beam divergence in order to create a parallel light beam or a negative beam divergence in order to focus the light beam, as known in the art of optical design. The transversally protruding flange 807 protrudes from the peripheral reflection surface 815 and is positioned in the lower part of the lens and the influence of the transversally protruding flange is thus very limited. The transversally protruding flange has further a laterally protruding part 823 which protrudes downwards from the peripheral entrance surface. This improves the strength of the transversally protruding flange. The first mating portion integrated into the resilient fingers will thus engage with the peripheral reflection surface and the transversally protruding flange and lock the lens in the lens holder.

Figure 9A:
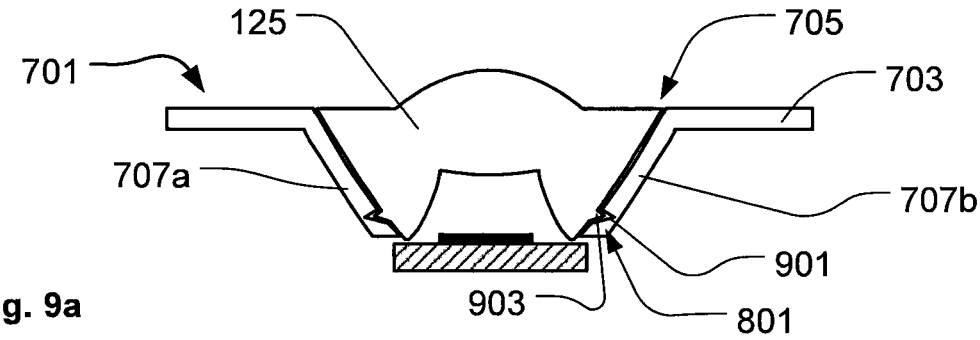
FIG. 9*a*-9*c* illustrate a cross sectional view of different lens assemblies.
Figure 9B:
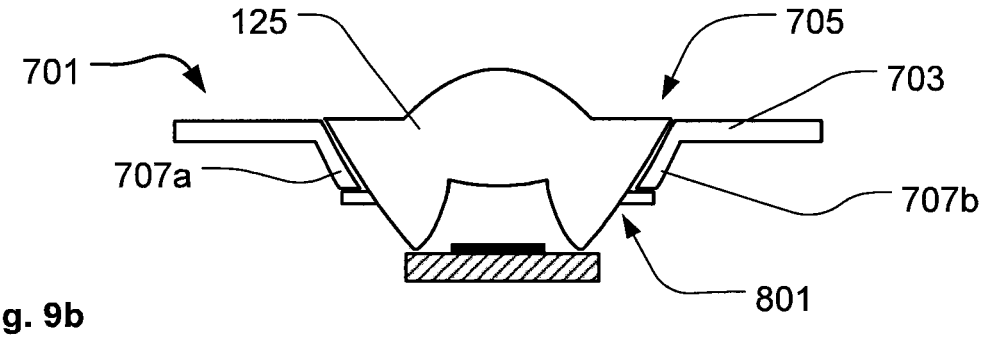
Figure 9C:
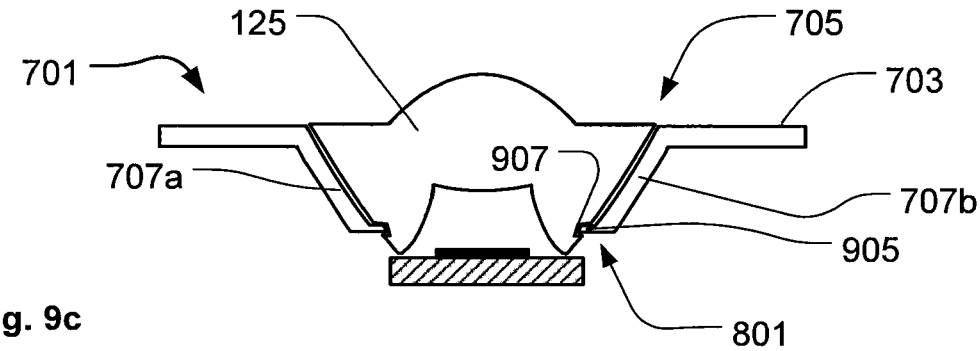
Figure 11A:
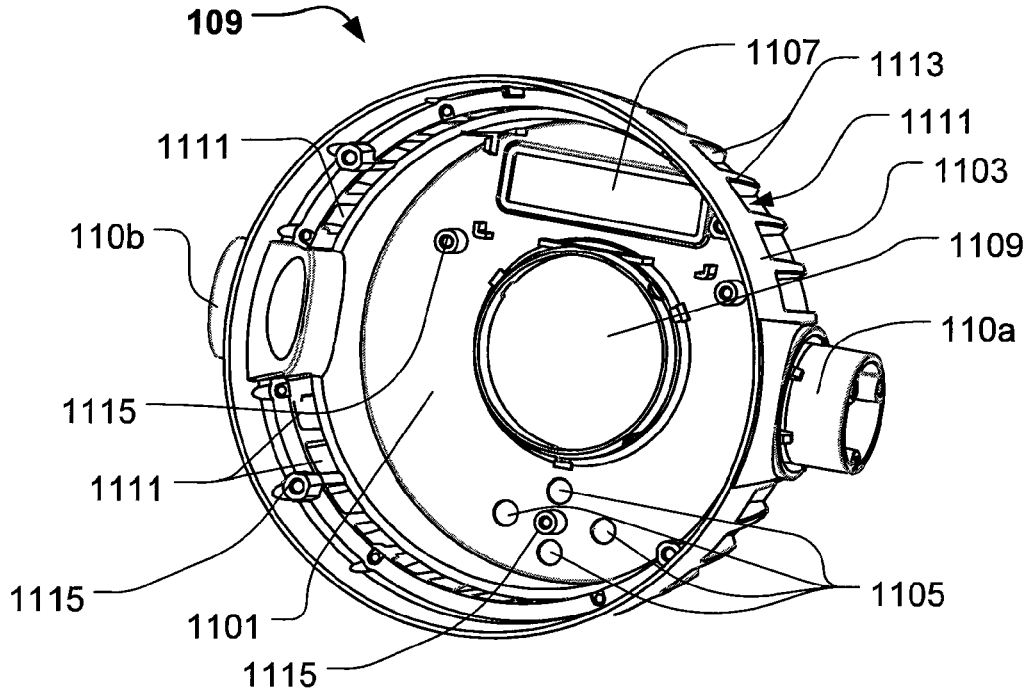
FIG. 11*a*-11*d* illustrate an embodiment of a bucket shaped head outer shell according to an aspect of the present invention
Figure 11B:
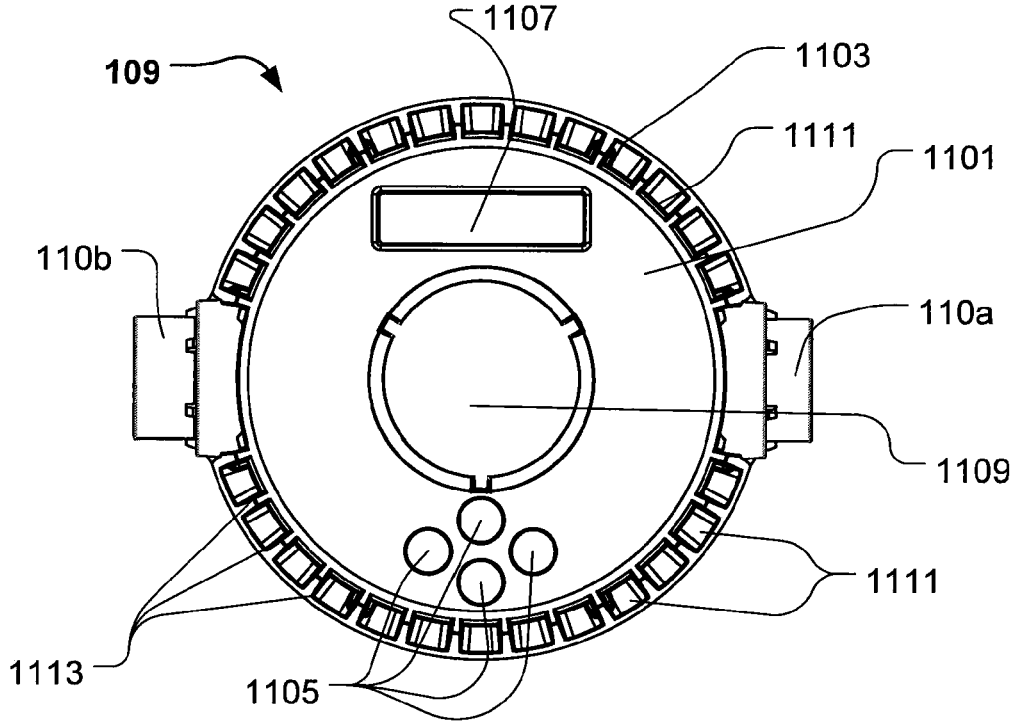
Figure 11C:
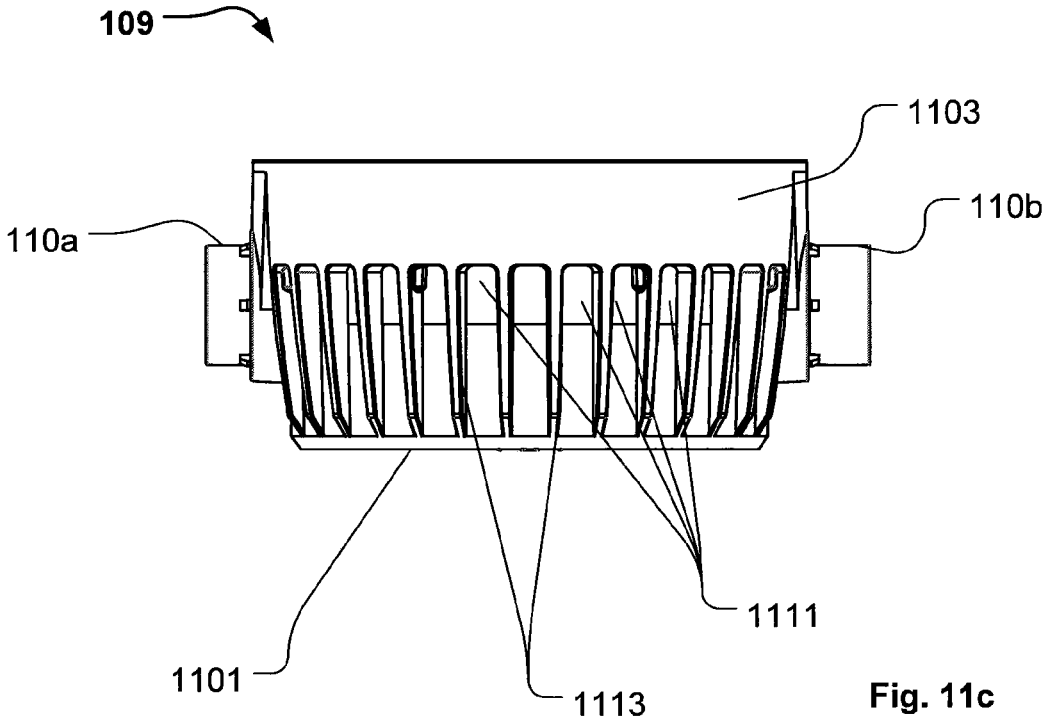
Figure 11D:
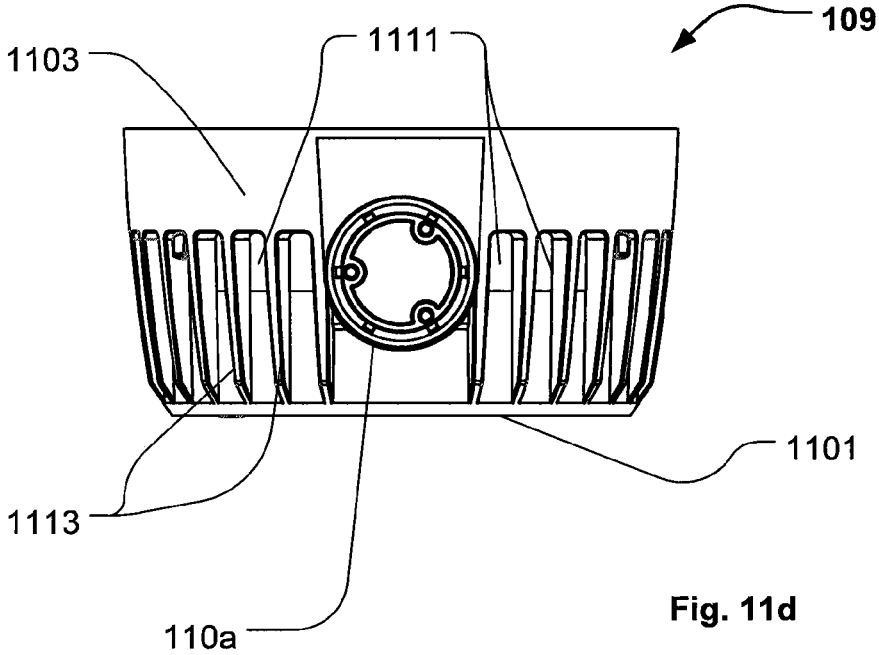

FIG. 9*a*-9*c* illustrate a cross-sectional view of a lens and lens holder and show different embodiments of the engagement mechanism 801 comprising a first mating portion integrated into the resilient fingers and a second mating portion integrated into the lens. In FIG. 9*a*, the first mating portion is embodied as a recess 901 in the resilient fingers and the second mating part is embodied as a protruding part 903 which is adapted to fit into the recess 901. FIG. 9*b* illustrates that the flange 807 transversally protruding from the lens also can be positioned at a higher position on the lens and that the resilient fingers in this embodiment are shorter. FIG. 9*c* illustrates an embodiment where the first mating parts integrated into the resilient fingers are embodied as an inwardly protruding flange 905 adapted to fit into a recess 907 in the lens. In this embodiment, the recess in the lens constitutes the second mating portion.

FIG. 11*a*-11*d* illustrate respectively a front perspective view, a rear view, a top view and a side view of the bucket shaped other shell 109. The bucket shape outer shell 109 may be defined as any shape having a bottom 1101 and sides 1103 which are forming a cavity, wherein a number of components can be arranged. The illustrated sides 1103 are as substantially cylindrical and the bottom 1101 is circular. However is it to be understood that the bottom and sides may have any shape as long as they form cavity wherein a number of components can be arranged. As a consequence the bucket shaped outer shell may alternatively be formed with a polygonal bottom surface with flat or curved side surfaces.

The bottom 1101 comprises a number of switch holes 1105 where through at number of switches (not shown) can extend through the bucket shaped outer shell 109 and thus be activated by a user for from outside of the head. Further the bottom comprises a display hole 1107 where through a display, which is positioned below/in the hole, can be seen. It is noticed that it is possible to position a transparent surface such as glass or plastic in the display hole in order to protect the display. It is to be understood that at the holes for switches and display can be arrange in many different patterns.

The bucket shaped outer shell 109 comprises also a two flanges 110*a* and 110*b* protruding outwards from the sides and which can be used to connect the head to the yoke as described above. The two flanges are illustrated as annular flanges which fit with a circular hole in the tilt bearings (FIG. 1*b*). However the flanges may have other shapes as long as they fit the hole in the center of the bearing e.g. the flanges may be polygonal if the hole inside the center of the bearing also is polygonal. In the illustrated embodiment the flanges are also hollow which allows connection of wires between the yoke and head however in other embodiments the flanges may also be solid.

A number of ventilation holes 1109 and 1111 are further provided at the bottom and sides. A fan can be adapted to force air through the head for instance by pulling air through the ventilation hold 1109 in the bottom and exhausting the air through the ventilation holes 1111 (only a few labeled) at the side surface or alternatively in the reverse direction.

A number of ribs 1113 have further been provided at the outer side of the bucket shaped outer shell. Theses ribs add strengths the bucket shaped outer shell and prevents deformation of the shell, whereby the head becomes a very robust construction. The ribs can further improve the head's the cooling effect if the bucket shaped outer shell is embodied in thermal conducting material as the ribs 1113 provides a larger contact surface with the surrounding air. As a consequence the bucket shaped head outer shell can assist in removal of heat generated by the components inside the bucket shaped outer shell.

The bucket shape outer shell comprises further a number of bosses 1115 whereto the internal components can be fastened using fastening means like screws or the like.

The bucket shaped outer shell may be embodied in a various number of materials for instance metals or polymers. The bucket shaped outer shell may be manufactured using casting techniques where the casting material is let inside a mold. Further it is possible to produce the bucket shaped outer shell using drawing technics as known in the art of material forming.

Figure 12A:
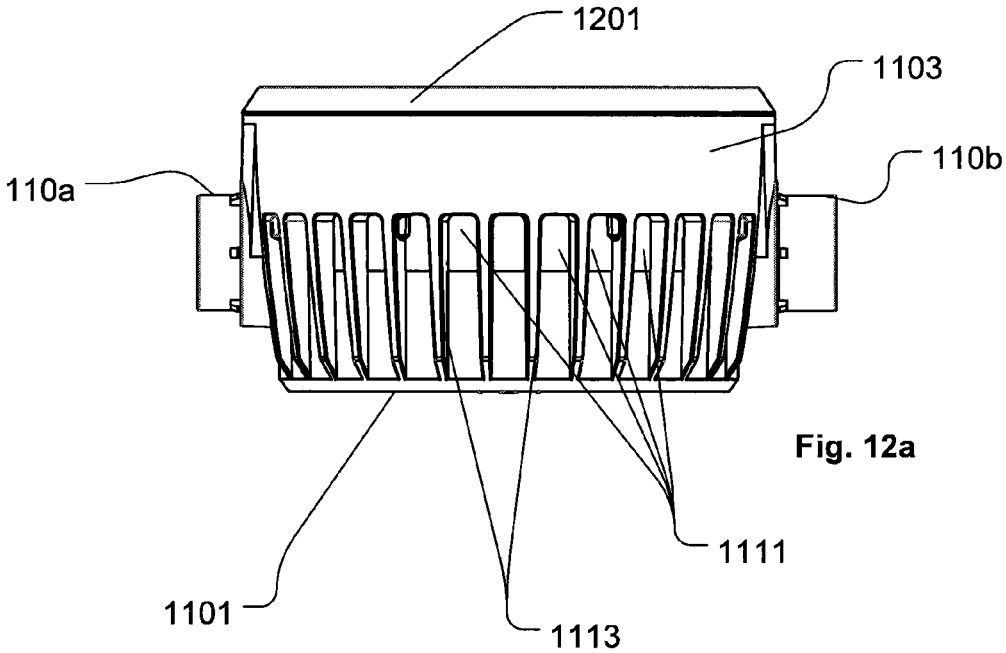
FIG. 12*a*-12*b* illustrates another embodiment of a bucket shaped head outer shell according to an aspect of the present invention.
Figure 12B:
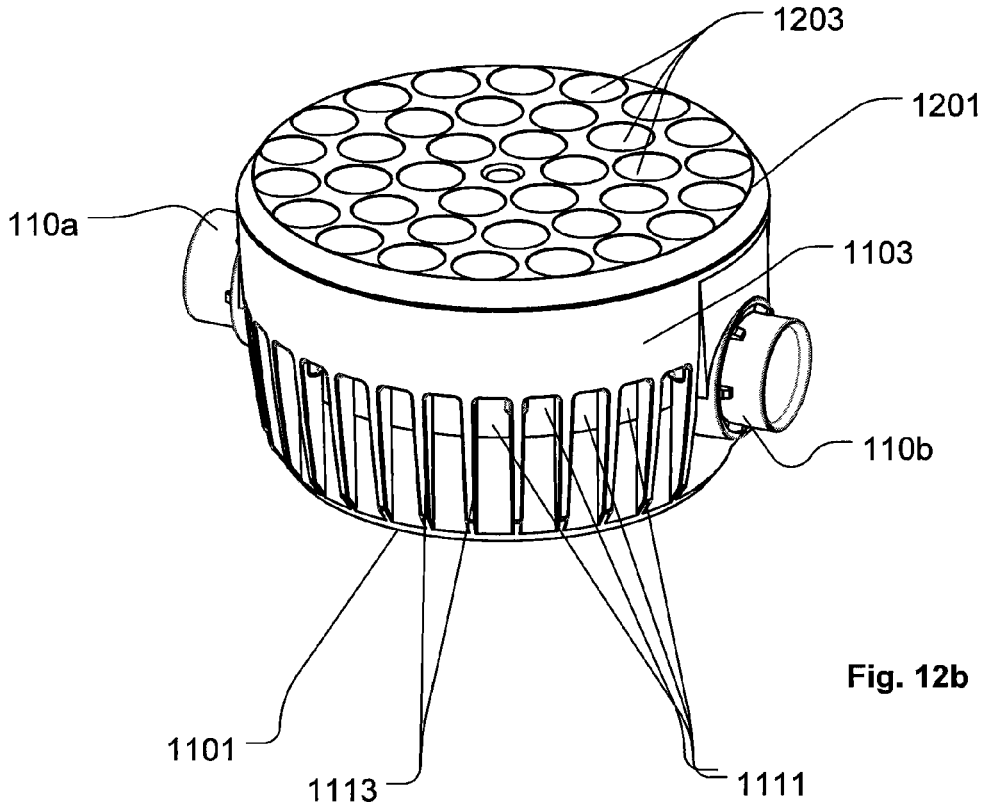

FIGS. 12*a* and 12*b* illustrates respectively a top view and a perspective view of another embodiment of the bucket shaped outer shell according to the present invention. In this embodiment the bucket shaped outer shell 109 have be covered by a cover 1201 comprising a number of clear areas 1203 where through the generate light can pass. The clear areas can be embodied of transparent material or as a number of apertures. The cover acts as a shielding member preventing stray light from exiting the head. Further the cover can be adapted to add further strength to the head.

The invention claimed is:

1. A moving head light fixture comprising:

a) a base;

b) a yoke rotatably connected to the base; and c) a head rotatably connected to the yoke, the head including a plurality of light sources disposed in a concave outer shell, the plurality of light sources being configured to generate a light beam, the moving head light fixture including the following components in a stacked configuration:

i) a main PCB having circuits for controlling the plurality of light sources, the main PCB being arranged at a bottom of the outer shell;

ii) a light source PCB whereon the light sources are mounted;

iii) a heat sink thermally connected to the light source PCB, the heat sink being disposed between the main PCB and the light source PCB; and iv) a fan disposed between the heat sink and the main PCB.

2. The moving head light fixture of claim 1, wherein the main PCB includes a number of switches extending through corresponding holes in the outer shell.

3. The moving head light fixture of claim 1, wherein the concave outer shell defines at least one flange protruding outwardly therefrom.

4. The moving head light fixture of claim 1, wherein the concave outer shell is molded in one piece.

5. The moving head light fixture of claim 4, wherein the concave outer shell is molded from polymeric material.

6. The moving head light fixture of claim 3, wherein the flange is rotatably connected to the yoke by way of a bearing attached to the flange.

7. The moving head light fixture of claim 1, wherein a plurality of optical lenses are arranged in the concave outer shell.

8. The moving head light fixture according to claim 1 wherein a top opening of said concave outer shell is covered by a cover wherein said cover comprises a number of clear areas where through said light generated by said light sources can pass.

9. A moving head light fixture comprising:

a) a base;

b) a yoke rotatably connected to the base; and c) a head rotatably connected to the yoke, the head including a plurality of light sources disposed in a concave outer shell, the plurality of light sources being configured to generate a light beam, wherein at least one of the following components is stacked in the concave outer shell disposed beneath the plurality of light sources within the outer shell:

i) a main PCB including circuits for controlling the light sources, wherein at least one display is connected to the main PCB and is visible through at least one hole defined in the concave outer shell;

ii) a light source PCB whereon the light sources are mounted; and iii) a heat sink thermally connected to the light source PCB.

10. A method of manufacturing an illumination device including a base, a yoke rotatably connected to the base, and a head rotatably connected to the yoke, the head including at least one light source, the method comprising:

a) providing the base and yoke; and b) providing the head, including (i) providing a concave outer shell and arranging the at least one light source in the concave outer shell, (ii) arranging a main PCB having circuits for controlling the at least one light source at a bottom of the concave outer shell, (iii) disposing a fan above the main PCB, (iv) disposing a heat sink above the fan, (iv) disposing a light source PCB above and in thermal contact with the heat sink, wherein the at least one light source is disposed on the light source PCB.

11. The method of claim 10, wherein the main PCB includes a plurality of switches, and wherein the step of stacking the main PCB includes disposing the plurality of switches into corresponding holes defined in the concave outer shell.

12. The method of claim 10, wherein the step of providing said head comprises the step of casting said concave outer shell is in one piece.

13. The method of claim 12, wherein the said step of casting the outer shell includes using polymer as casting material.

14. The method of claim 12, wherein providing the head includes disposing a cover at a top opening the outer shell including a plurality of clear regions for light to traverse.

15. A method of manufacturing an illumination device including a base, a yoke rotatably connected to the base, and a head rotatably connected to the yoke, the head including at least one light source, the method comprising:

a) providing the base and yoke;

b) providing the head by providing a concave outer shell and arranging the at least one light source in the concave outer shell, wherein at least one of the following components is stacked in the concave outer shell: (i) a main PCB having circuits for controlling the light sources and (ii) a light source PCB whereon the at least one light source is mounted and a heat sink thermally connected to the light source PCB; wherein the method further comprises connecting at least one display to the main PCB and arranging the display in the concave outer shell such that the display is visible through at least one hole in the concave outer shell when the main PCB is provided.

16. A moving head light fixture comprising:

a) a base;

b) a yoke rotatably connected to the base;

c) a head rotatably connected to the yoke, the head including a plurality of light sources disposed in a concave outer shell, the plurality of light sources being configured to generate a light beam;

d) means for receiving user input from a user extending through a plurality of holes defined in a bottom surface of the head; and e) a display for providing visual feedback to the user arranged such that the display can be seen through a display hole defined in the bottom surface of the head.

17. The moving head light fixture of claim 16, wherein the means for receiving user input includes a touch pad.

18. The moving head light fixture of claim 17, wherein the touch pad is transparent and integrated into the display.

19. The moving head light fixture of claim 16, wherein the means for receiving user input from a user includes a plurality of switches.

20. The moving head light fixture of claim 16, wherein the head defines a plurality of ventilation holes at a bottom surface and at a side surface thereof, and wherein the fan forces air through the head by pulling air through one of the ventilation holes and exhausting said air through another one of the ventilation holes.

21. The moving head light fixture of claim 20, wherein the fan pulls air through a ventilation hole in the bottom surface of the head and exhausts air through a ventilation hole defined in the side surface of the head.

22. The moving head light fixture of claim 21, wherein the fan pulls air through a ventilation hole in the side surface of the head and exhausts air through a ventilation hole in the bottom surface of the head.

* * * * *